United States Patent [19]

Golobay

[11] 4,167,343

[45] Sep. 11, 1979

[54] PRINT WIRE ACTUATOR MECHANISM

[76] Inventor: Gary L. Golobay, 1215 Helen, Augusta, Kans. 67010

[21] Appl. No.: 870,826

[22] Filed: Jan. 19, 1978

Related U.S. Application Data

[63] Continuation of Ser. No. 726,432, Sep. 27, 1976, abandoned.

[51] Int. Cl.[2] ..... B41J 3/12

[52] U.S. Cl. ..... 400/124; 101/93.05

[58] Field of Search ..... 197/1 R; 101/93.04, 101/93.05, 93.15, 93.28, 93.29, 93.32–93.34, 93.48; 335/270, 274, 276; 400/124

[56] References Cited

U.S. PATENT DOCUMENTS

| | | | |
|---|---|---|---|
| 3,672,482 | 6/1972 | Brumbaugh et al. | 197/1 R |
| 3,745,495 | 7/1973 | Chai et al. | 101/93.29 X |
| 3,748,613 | 7/1973 | Venker | 101/93.29 X |
| 3,878,778 | 4/1975 | Gomi | 101/93.29 |
| 3,906,854 | 9/1975 | Gomi | 101/93.34 |
| 3,973,661 | 8/1976 | De Boo et al. | 197/1 R |
| 3,982,622 | 9/1976 | Bellino et al. | 197/1 R |

*Primary Examiner*—Paul T. Sewell
*Attorney, Agent, or Firm*—Phillip A. Rein

[57] ABSTRACT

This invention relates to a wire matrix printer system using a plurality of unique print wire actuator mechanisms operable to print dots on a printing medium. The novelty is in each print wire actuator mechanism using an electro-mechanical combination including (1) a print wire actuator; (2) a permanent magnet collector; (3) a solenoid collector; and (4) a connector assembly holding the aforementioned together as a unit. The print wire actuator includes a print wire assembly having a wire member moved through a printing stroke under the unique combined force of (1) a torsion rod, and (2) a solenoid member. Additionally, the wire member is returned to the rest or starting position under the force of the torsion rod and a permanent magnet collector member.

7 Claims, 6 Drawing Figures

PRINT WIRE ACTUATOR MECHANISM

This is a continuation of application Ser. No. 726,432, filed Sept. 27, 1976, now abandoned.

Numerous types of print wire actuators for matrix printer mechanisms are known to the prior art using permanent magnets or electrical magnetic solenoids but none use a combination thereof similar to applicant's usage. Speed of movement of a print wire member is of utmost importance and none of the many prior art devices achieve the speed and accuracy of the print wire actuator mechanisms of this invention.

In one preferred embodiment of this invention, a plurality of print wire actuator mechanisms are provided in a wire matrix printer system to achieve a read out on a tape or sheet writing material. Each print wire actuator mechanism includes (1) a print wire actuator means; (2) a permanent magnet collector means associated with one portion of the print wire actuator means; (3) a solenoid collector means associated with an opposite portion of the print wire actuator means; and (4) a connector assembly holding the aforementioned elements in a closely associated relationship for proper operation thereof. The print wire actuator means includes a print wire assembly mounted on a central collector member and a solenoid member mounted on the central collector member and a portion of the print wire assembly. The print wire assembly includes an armature assembly having a main armature body with one end connected to a torsion rod member and the other end connected to a wire member. The torsion rod member is connected to the central collector member and a portion of the main armature body extends within a central open cavity of the solenoid member. The permanent magnet collector means includes a permanent magnet collector member mounted against a permanent magnet member, which, in turn, is mounted against one side of the central collector member. The solenoid collector means includes a solenoid collector member which is mounted against the other side of the central collector member. The connector assembly is a nut and bolt member to hold the elements in the proper relationship so that movement of the wire member is affected by the permanent magnet member, the solenoid member, and the torsion rod member.

One object of this invention is to provide a wire matrix printer system having a plurality of print wire actuator mechanisms which are compact in size, fast and accurate in operation, and durable in construction.

Another object of this invention is to provide a print wire actuator mechanism having a wire printer member actuated through a combination of permanent magnets, solenoids, and torsion rod forces.

Still, another object of this invention is to provide a print wire actuator mechanism having a wire printer member that is positively powered in both directions of travel for increased speed and accuracy.

One other object of the print wire actuator mechanism of this invention is to provide an economical structure that is rigid in construction, easily actuated, compact in nature, and adapted to be used with numerous wire matrix printer systems.

Various other objects, advantages, and features of the invention will become apparent to those skilled in the art from the following discussion, taken in conjunction with the accompanying drawings, in which.

Figure 1:
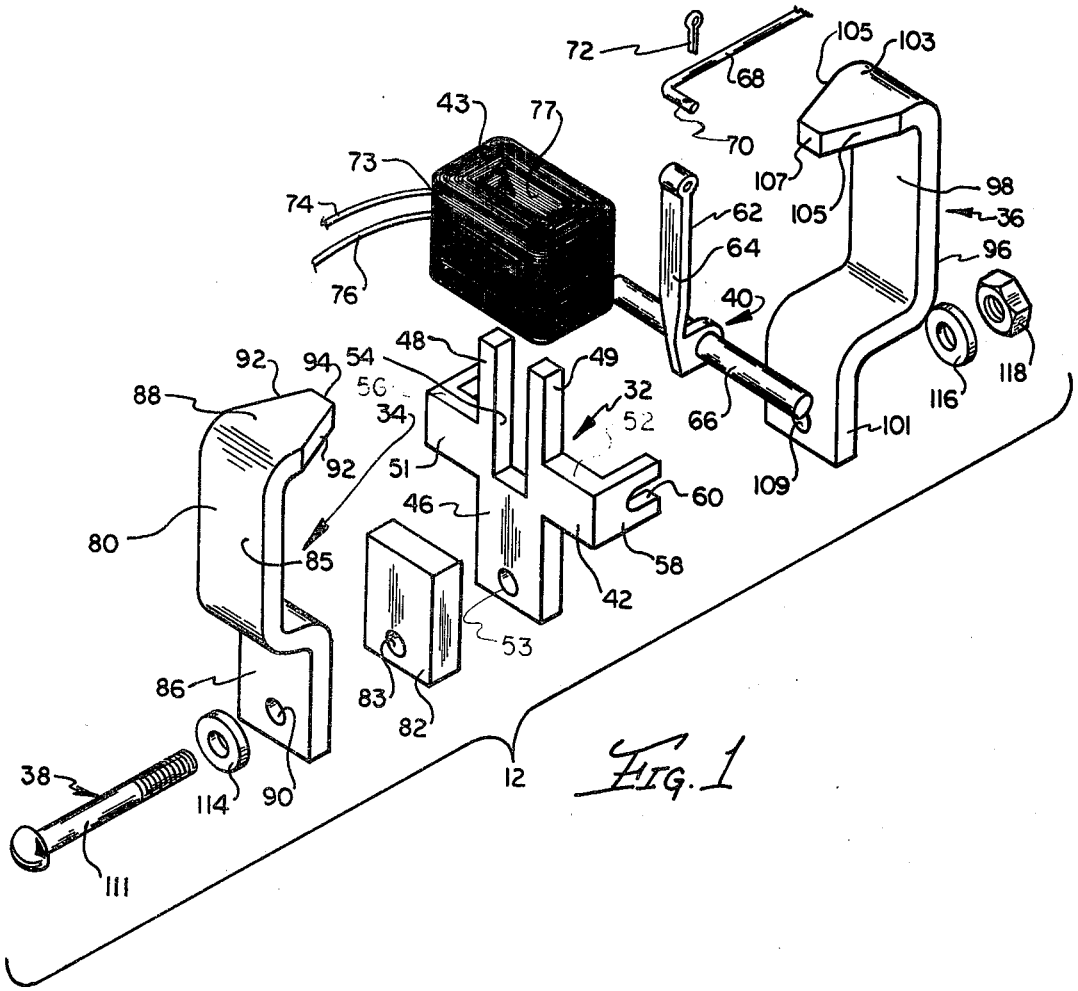
FIG. 1 is an enlarged exploded perspective view of a print wire actuator mechanism of this invention.

The following is a discussion and description of preferred specific embodiments of the new print wire actuator mechanism of this invention, such being made with reference to the drawings, whereupon the same reference numerals are used to indicate the same or similar parts and/or structure. It is to be understood that such discussion and description is not to unduly limit the scope of the invention.

Figure 3:
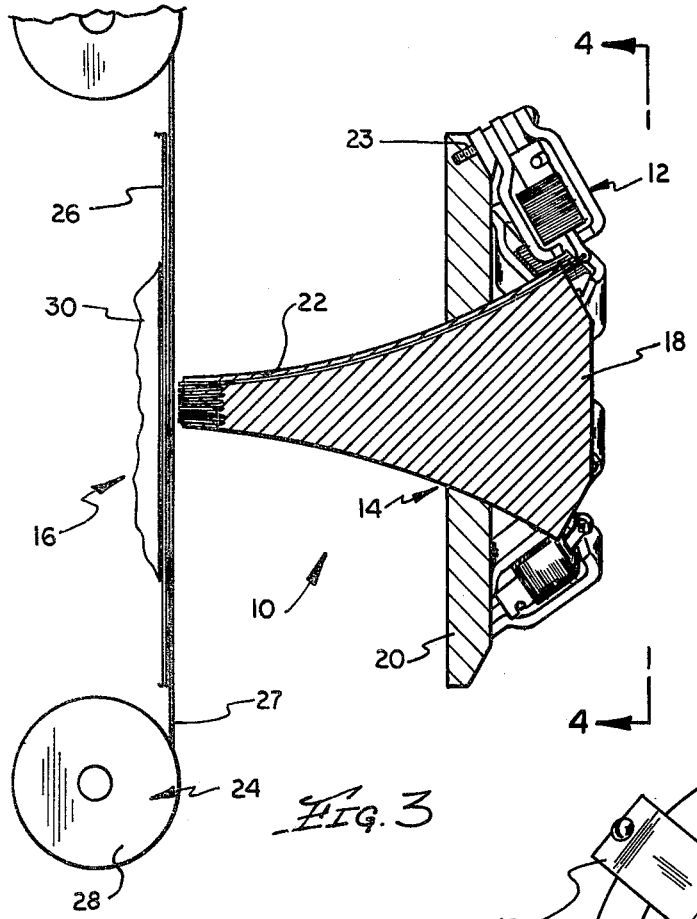
FIG. 3 is a sectional view of a wire matrix printer system utilizing the print wire actuator mechanisms of this invention.
Figure 4:
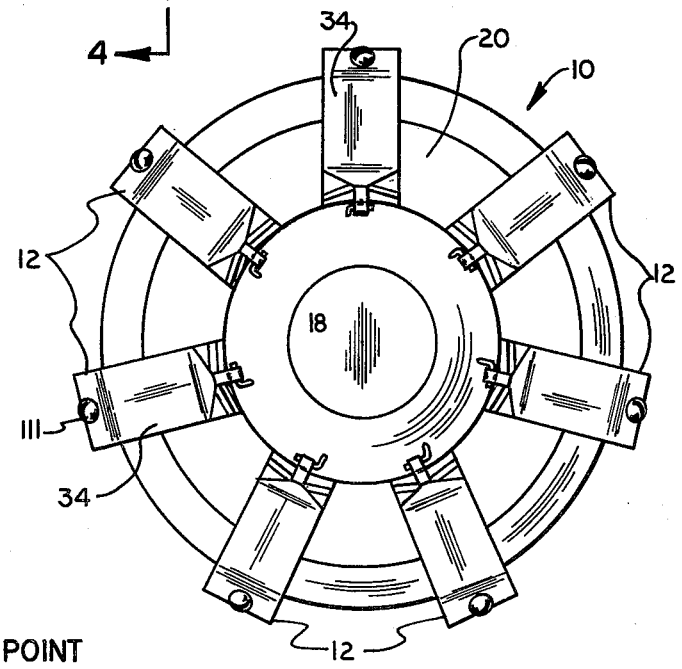
FIG. 4 is a view taken along line 4—4 in FIG. 3 showing the complete plan view thereof.

Referring to the drawings in detail and in particular to FIGS. 3 and 4, a portion of a wire matrix printer system, indicated generally at 10, is shown with a plurality, namely seven, of the print wire actuator mechanisms 12 of this invention. The wire matrix printer system 10 is of a generally conventional type used to transmit electrical impulses into printing on a tape or sheet material.

Our invention lies in new and novel print wire actuator mechanisms 12 mounted in a circle on a support means 14 and operably associated with a ribbon and tape mechanism 16. The support means 14 includes a conical support head 18 secured to an actuator mechanism support member 20. The conical support head 18 has a plurality of print wire channels 22, each associated with a respective one of the print wire actuator mechanisms 12. The print wire channels 20 are situated so that the open outer ends thereof form a vertical, aligned row of openings.

The actuator mechanism support member 20 is of a generally circular shape having spaced threaded holes 23 therein used to secure the print wire actuator mechanisms 12 thereon in a manner to be described.

The ribbon and tape mechanism 16 is of a conventional nature having a ribbon assembly 24 operably associated with a paper assembly 26. The ribbon assembly 24 includes a ribbon member 27 trained about two roller or spool members 28 operable like a typewriter ribbon.

The paper assembly 26 includes a paper member 30 (either tape or sheet) mounted on a roller assembly (not shown) and movable relative to the conical support head 18 which will move horizontally to transfer dots to the paper member 30. The operation of print wire members and a ribbon and tape mechanism is substantially coventional with this invention relating to means for moving the print wire members as will be explained.

The use and operation of wire matrix printing mechanisms to create letters and numbers on a matrix of dots such as 5 dots wide and 7 dots high is readily known to the prior art. The details of such printing mechanisms to send impulses to a print wire actuator mechanism is believed conventional and not necessary to describe in detail herein.

Figure 2:
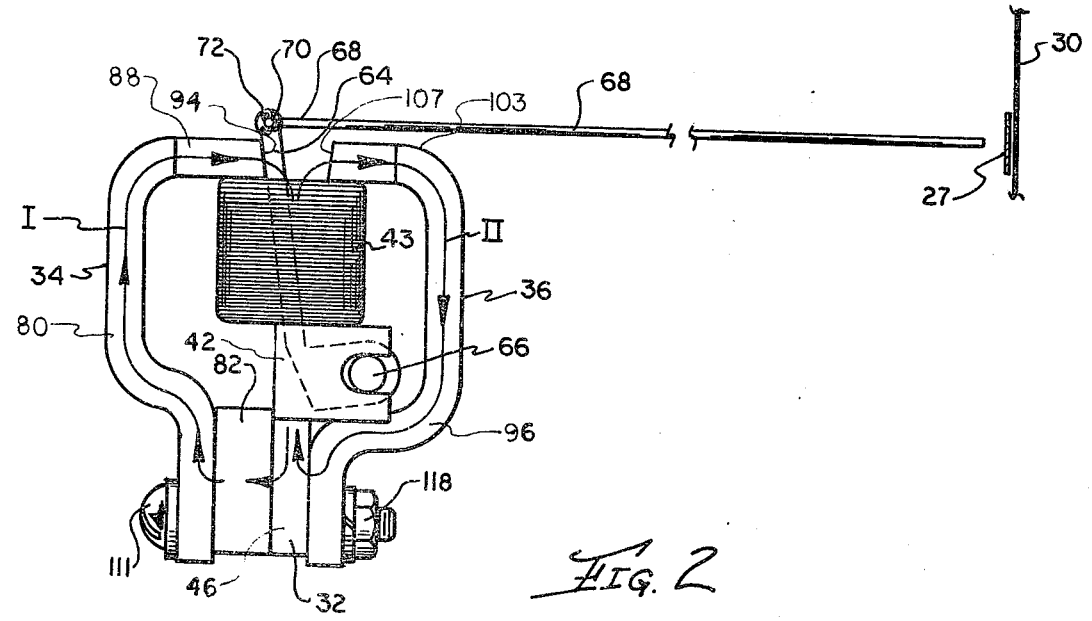
FIG. 2 is a side elevational view of the print wire actuator mechanism of this invention.

As best shown in FIGS. 1 and 2, each print wire actuator mechanism 12 includes (1) a print wire actuator means 32; (2) a permanent magnet collector means 34; (3) a solenoid collector means 36; and (4) a connector assembly 38 holding aforementioned elements in the assembled condition. The print wire actuator means 32 includes a print wire assembly 40 connected to a central collector member 42 and a solenoid member 43 mounted on the central collector member 42 and about a portion of the print wire assembly 40.

The central collector member 42 is of an irregular shape having a main body 46 with integral upright solenoid support arms 48, 49, and laterally extended wire assembly support arms 51, 52. The main body 46 is formed with a central connector hole 53 for reasons to be explained. A U-shaped opening 54 is positioned between the solenoid support arms 48, 49 for reasons to be explained.

Each wire assembly support arm 51, 52 includes an intermediate section 56 with a laterally extended connector section 58, which, in turn, is formed with a U-shaped groove 60.

As shown in FIG. 1, the print wire assembly 40 includes an armature assembly 62 having a main armature body 64 secured at a lower end to a torsion rod member 66 and a print wire member 68 is secured to an upper end thereof. The torsion rod member 66 resembles a support shaft with outer ends secured to respective ones of the U-shaped grooves 60 in the wire assembly support arms 51, 52. The torsion rod member 66 is constructed of a non-magnetic material for reasons to be explained.

Each print wire member 68 is of elongated rigid construction having one end formed with a connector portion 70 secured by a cotter key 72 to the upper end of the main armature body 64.

The solenoid member 43 includes a coil body 73 having electrical connector leads 74 and 76, extended therefrom. The leads 74, 76 are connectable to a power source to energize the solenoid member 43 as desired. The coil body 73 is of a conventional nature formed with a central cavity 77 to be placed about the solenoid support arms 48, 49, to hold in a laterally stable condition.

The permanent magnet collector means 34 includes a permanent magnet collector member 80 adjacent a permanent magnet member 82. The permanent magnet member 82 is of a rectangular block shape having a magnet connector hole 83.

The permanent magnet collector member 80 is of a question mark shape having a central main body 85 integral with an offset lower connector section 86 and an upper actuator head section 88. The connector section 86 includes a connector hole 90 for reasons to be explained. The upper actuator head section 88 is of generally V-shape having inclined sidewalls 92 integral with an endwall 94.

The solenoid collector means 36 is substantially identical to the permanent magnet collector member 80 having a solenoid collector member 96 with a central body 98 formed with an integral offset lower connector portion 101 and an upper actuator head portion 103. The upper actuator head portion 103 is formed with inclined sidewalls 105 integral with an endwall 107. The offset lower connector portion 101 is formed with a lower connector hole 109.

As shown in FIG. 1, the connector assembly 38, which is constructed of a non-magnetic material, includes an elongated bolt member 111; first and second washer members 114, 116; and a nut member 118.

ASSEMBLY PROCEDURE

In the assembly of the print wire actuator mechanism 12 of this invention, the armature assembly 62 is secured as by welding or the like to the central collector member 42. More specifically, opposite ends of the torsion rod member 66 are placed within respective ones of the U-shaped grooves 60 of the wire assembly support arms 51, 52 and secured thereto. This is achieved wherein the main armature body 64 and the solenoid support arms 48, 49 are extended parallel and adjacent with a respective equal spacing therebetween of 0.003 to 0.004 inch. Therefore, movement of the main armature body 64 from its vertical position creates a torsion force on the torsion rod member 66 to return to the vertical position.

Next, the solenoid member 43 is placed over the solenoid support arms 48, 49 and held by adhesives or press fit. The central cavity 77 of the solenoid member 43 is such to allow the main armature body 64 to pivot and twist the torsion rod member 66 and move laterally relative to the vertical axes of the solenoid support arms 48, 49.

As shown in FIG. 2, the permanent magnet member 82 is placed against the main body 46 of the central collector member 42 and the permanent magnet collector member 80 is placed against the permanent magnet member 82. The endwall 94 of the upper actuator head section 88 is directed inwardly toward the main armature body 64.

Next, the solenoid collector member 96 is placed against the main body 46 of the central collector member 42 with the endwall 107 of the upper actuator head portion 103 placed adjacent the main armature body 64.

The connector assembly 38 is utilized with the first washer member 114 placed about the bolt member 111, which, in turn, is successively inserted through the connector hole 90, the magnet connector hole 83, the central connector hole 53, and the lower connector hole 109. The second washer member 116 is placed about the outer end of the bolt member 111 and the nut member 118 placed therein and tightened to the condition of FIG. 2.

As shown in FIG. 4, a plurality, namely, seven, of the assembled print wire actuator mechanisms 12 are secured to the actuator mechanism support member 20 in equally spaced distances thereabout. A print wire member 68 is secured to respective ones of the outer ends of the main armature bodies 64 of the print wire actuator mechanisms 12 and trained through the print wire channels 22. This completes the assembly of a portion of the wire matrix print system 10 as shown in FIGS. 3 and 4.

THEORY OF OPERATION

One should keep in view the drawings of both the exploded view and the assembled view of the actuator in order to follow the explanation.

First, we shall examine each print wire actuator mechanism 12 statically and followed by an explanation of the conjoint print wire actuator mechanisms' 12 operation.

When the permanent magnet collector member 80, the central collector member 42, and the solenoid collector member 96 are installed adjacent to the permanent magnet member 82, magnetic flux begins to flow in what is defined as flux path "I" as shown in FIG. 2. This flux path I travels from the left face of the permanent magnet member 82 (as viewed in FIG. 2) into the permanent magnet collector member 80 and thence, into the main armature body 64. The flux path I proceeds from the main armature body 64 across a small air gap and into the central collector member 42 and the flux path I is completed as it returns to the right side of the permanent magnetic member 82.

According to known classical magnetic theory, a force normal to both surfaces is established when magnetic flux travels from one material, through space, and into a second material and hence, the main armature body 64 is attracted toward the permanent magnet collector member 80. As the main armature body 64 so moves, the torsion rod member 66 is flexed and energy is stored therein. This energy storing process is torsional spring action and the main armature body 64 is pulled solidly against the permanent magnet collector member 80 and held ready to begin motion toward the solenoid collector member 96 when released.

As the flux path I travels between the permanent magnet collector member 80 and the main armature body 64, it also flows across the small but equal air gaps between the main armature body 64 and central collector member 42. This occurs as the torsion rod member 66 is preferably constructed of a stainless steel, nonmagnetic material. However, no lateral magnetic forces are desired so the magnetic material of the solenoid support arms 48, 49 are spaced equally on both sides of the main armature body 64. This equal gap spacing along with equal amounts of magnetic material causes the magnetic forces between the main armature body 64 and the central collector member 42 to be equal and opposite with a net force of essentially zero. This allows the main armature body 64 to be free to move towards either the permanent magnet collector member 80 or the solenoid collector member 96 without dragging on either of the solenoid support arms 48, 49. The solenoid collector member 96 has no function in this static mode of the print wire actuator mechanism 12 but is important when the solenoid member 43 is pulsed.

When the main armature body 64 begins to move after the solenoid member 43 is pulsed, the solenoid collector member 96 becomes part of the magnetic path for the flux generated by the solenoid member 43 and designated as flux path "II". As shown in FIG. 2, the flux path II moves from the center of the solenoid member 43, into the main armature body 64 and into the solenoid collector member 96 and into the main body 46 of the central collector member 42. The flux path II is completed as the flux flows up the central collector member 42 and back into the solenoid member 43.

OPERATION OF THE INVENTION

As to the firing action of this one print wire actuator mechanism 12, this is the action causing the print wire member 68 to move from its rest position (as shown in FIG. 2) outwardly to contact the ribbon member 27, impress upon the paper member 30, and return to the rest position. In order to move the main armature body 64 from the rest position of FIG. 2, an electric current is supplied to the electrical connector leads 74, 76 and flows to the coil body 73 of the solenoid member 43.

The current flow in the solenoid member 43 is such that the solenoid magnetic field is opposite to that of the permanent magnet member 82 so the two fields tend to cancel and no net flux or force is present in flux path I. Applying this theory to the print wire actuator mechanism 12, when current flows to the coil body 73 of the solenoid member 43, the flux traveling in flux path I (FIG. 2) is canceled and the main armature body 64 is released. This initiates the main armature body 64 in motion towards the solenoid collector member 96 under forces supplied by the torsion rod member 66. At the same instant, flux forces have begun to flow in flux path II since it presents an unhindered path as the solenoid member 43 has current flowing through it. This initial magnetic force, though weak due to the large distance between the main armature body 64 and solenoid collector member 96, adds to the force from the torsion rod member 66 and helps accelerate the main armature body 64 and interconnected print wire member 68 toward the solenoid collector member 96. This combination represents the important feature of the invention as it achieves the summing of two forces, the torsion rod forces and the magnetic forces. Since magnetic forces grow weak rapidly as the air gap grows between the main armature body 64 and the three named collectors, the torsion spring force supplements the magnetic forces at both extreme positions of movement of the main armature body 64 where they are weak. The solenoid support arms 48, 49 form part of both flux path I and flux path II during operation.

When the main armature body 64 has passed from the permanent magnet collector member 80 over the endwall 107 of the solenoid collector member 96, the current flowing in to the coil body 73 is ceased. At this time, we establish action with the same accelerating forces on the main armature body 64 but in the opposite direction. When the current to the coil body 73 has ceased, the permanent magnet flux has re-established itself through the permanent magnet collector member 80 and flux path I. The torsion rod member 66 has rotated over its neutral point and has stored energy when it reached the solenoid collector member 96. This stored energy acts through the main armature body 64 to aid in restoring the main armature body 64 against the permanent magnet collector member 80 to the rest position. This completes the firing action of the print wire actuator mechanism 12 and the main armature body 64 will remain in the rest position until the solenoid member 43 is pulsed again. In this manner, the main armature body 64 and its connected print wire member 68 are powered in both directions with high initial starting forces at both ends of the stroke. This is a very desirable arrangement for long wire stroke (0.035 to 0.045 inch), high energy, print wire actuator mechanisms 12.

FORCE RELATIONSHIPS

It is known that magnetic forces vary as a function of the air gap between two flux conducting members and the magnetic forces drop rapidly on a small increase of air gap. This relation of magnetic forces verus air gap distance is called the inverse square law. For the main armature body 64 in this invention, the forces drop very rapidly in the first 0.010 inch motion and any motion past this would have to depend on very weak magnetic forces. However, as stated earlier, this main armature body 64 always sums forces to avoid weak accelerating forces at extreme distances.

Figure 5:
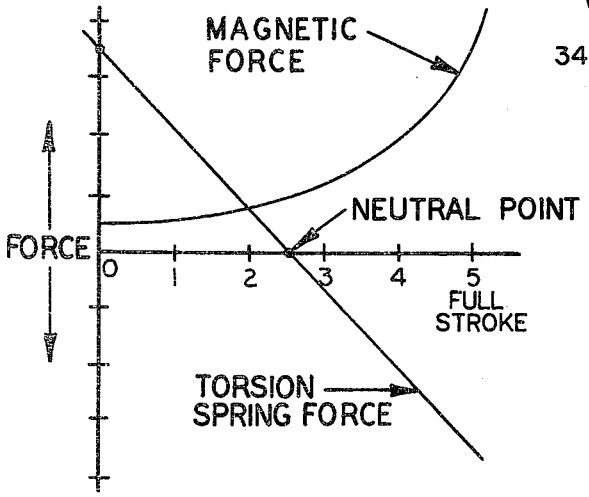
FIG. 5 is a chart showing forces acting on an armature member from a magnetic field and a torsion rod member.

Assuming current has just begun to flow in the solenoid member 43, we can plot both the torsion spring force and the magnetic forces acting on the main armature body 64. As shown on the graph in FIG. 5, notice the torsion rod member 66 passes through a neutral point at the exact center between the endwalls 94, 107 of the respective permanent magnet collector member 80 and the solenoid collector member 96. After the torsion rod member 66 has given up all the energy previously stored and is now being torqued in the opposite direction as the main armature body 64 approaches the solenoid collector member 96. This action stores energy for the main armature body 64 return trip to the permanent magnet collector member 80.

The combination of forces of the torsion spring force and the magnetic force from the solenoid collector member 96 can now be added together mathmatically to show the net force acting on the main armature body 64.

Figure 6:
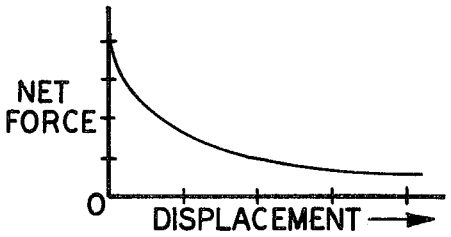
FIG. 6 is a chart showing relationship of net force and displacement of the armature member.

On referring to FIG. 6, the net forces are very high at the beginning of the stroke of the main armature body 64 where it is needed the most for early acceleration and fast action.

CONCLUSION

It is seen that the print wire actuator mechanism of this invention presents a print wire actuator that is very accurate and fast acting. The combination of magnetic and mechanical forces achieves a superior combination of net forces for moving a printer wire member.

The print wire actuator mechanism presents a structure compact in nature, durable in operation, and reduces time of actuation.

While the invention has been described in conjunction with preferred specific embodiments thereof, it will be understood that this description is intended to illustrate and not to limit the scope of the invention, which is defined by the following claims.

I claim:

1. In a wire matrix printer system operable to print dots on a readout sheet material, a print wire actuator mechanism, comprising:

(a) a print wire actuator means including a print wire assembly connected to a central collector member and operably connected to a solenoid member;

(b) a permanent magnet collector means having a magnet member mounted against one side of said central collector member;

(c) a solenoid collector means having a solenoid collector member mounted against one other side of said central collector member;

(d) said print wire assembly including a print wire member connected to an armature assembly;

(e) said print wire member moved to an actuation print stroke on energization of said solenoid member;

(f) said print wire actuator means having a first flux path through said magnet member, said permanent magent collector means, and said armature assembly to hold said print wire member in an inactive, rest, position;

(g) on the energization of said solenoid member, the first flux path is cancelled and a second flux path is created through said solenoid member, said central collector member, and said solenoid collector means to urge said print wire member to a print, actuated position having a portion of said armature assembly in contact with said solenoid collector member;

(h) said central collector member having a pair of spaced, upright solenoid support arms;

(i) said solenoid member mounted about said solenoid support arms to form a central cavity therebetween;

(j) said armature assembly having a main armature body mounted within said cavity and baised toward said permanent magnet collector means by said magnet member and said first flux path; and (k) energization of said solenoid member biases said main armature body toward said solenoid collector means under flux forces of said second flux path.

2. A print wire actuator mechanism as described in claim 1, wherein:

(a) said permanent magnet collector means having a permanent magnet collector member;

(b) said permanent magnet collector member includes a central main body integral with a lower connector section positioned against said magnet member and an upper actuator head section; and (c) said armature assembly in contact with said upper actuator head section when influenced by the first flux path.

3. A print wire actuator mechanism as described in claim 1, wherein:

(a) said armature assembly including said main armature body having an upper end connected to said print wire member and a lower end secured to a torsion rod member;

(b) said torsion rod member positioned below said solenoid member; whereby said torsion rod member is in a neutral condition with said main armature body in a vertical position when not acted upon by any magnetic forces;

(c) said main armature body positioned against said permanent magnet collector means under force of the first flux path from said permanent magnet;

(d) said torsion rod member in the inactive, rest, position having a torque load thereon biasing said main armature body toward a print, actuated position;

(e) said torsion rod member in the print actuated position having a torque load thereon biasing said main armature body toward the inactive, rest, position;

(f) said main armature body positioned against said solenoid collector means under force of the second flux path on energization of said solenoid member; and (g) said main armature body extended perpendicular to said torsion rod member and positioned in said central cavity of said solenoid member.

4. A print wire actuator mechanism as described in claim 1, wherein:

(a) said armature assembly including said main armature body having an upper end connected to said print wire member and a lower end secured to a torsion rod member;

(b) said torsion rod member positioned below said solenoid member; whereby said torsion rod member is in a neutral condition with said main armature body in a vertical position when not acted upon by any magnetic forces; and (c) said central collector member having a pair of wire assembly support arms extended outwardly and laterally of a main body, each having a connector section to securely support a respective end of said torsion rod member, whereby movement of said main armature body from vertical position creates a torque force to move said print wire member in the opposite direction.

5. A print wire actuator mechanism as described in claim 4, wherein:

(a) said torsion rod member is constructed of a nonmagnetic material and of a cylindrical shape; and (b) said armature assembly secured to a central portion and extended laterally of said torsion rod member; whereby said torsion rod member is twisted from a neutral position about a central axis when acted upon by the first and second flux paths.

6. A print wire actuator mechanism as described in claim 1, wherein:

(a) said solenoid collector means having a solenoid collector member;

(b) said solenoid collector member includes a central body integral with a lower connector portion positioned against said central collector member and an upper actuator head portion; and (c) said armature assembly in contact with said upper actuator head portion when influenced by the second flux path.

7. A print wire actuator mechanism as described in claim 6, wherein:

(a) said actuator head portion is formed with inclined sidewalls to form an endwall therebetween; and (b) said armature assembly including a main armature body having an upper end connected to said print wire member and a lower end secured to a torsion rod member; and (c) said upper end of said main armature body in contact with said endwall of said actuator head portion when influenced by the second flux path.

* * * * *